US005419813A

United States Patent [19]

Heinzmann

[11] Patent Number: 5,419,813

[45] Date of Patent: May 30, 1995

[54] PAPER MACHINE HEADBOX WITH ADJUSTABLE LOWER LIP

[75] Inventor: Helmut Heinzmann, Böhmenkirch, Germany

[73] Assignee: J.M. Voith GmbH, Heidenheim, Germany

[21] Appl. No.: 145,971

[22] Filed: Oct. 29, 1993

[30] Foreign Application Priority Data

Nov. 5, 1992 [DE] Germany ..... 42 37 306.9
Dec. 5, 1992 [DE] Germany ..... 42 41 076.2

[51] Int. Cl.[6] ..... D21F 1/06
[52] U.S. Cl. ..... 162/344; 162/347
[58] Field of Search ..... 162/336, 344, 347

[56] References Cited

U.S. PATENT DOCUMENTS

| | | | |
|---|---|---|---|
| 1,898,372 | 2/1933 | Hyde | 162/347 |
| 3,843,470 | 10/1974 | Betley et al. | 162/343 |
| 3,853,695 | 10/1974 | Back et al. | 162/336 |
| 4,133,713 | 1/1979 | Chuang | 162/216 |
| 4,326,916 | 4/1982 | Flaig et al. | 162/344 |
| 4,416,730 | 11/1983 | Schiel | 162/344 |
| 4,427,491 | 1/1984 | Rotdvan et al. | 162/344 |
| 4,504,360 | 3/1985 | Fujiwara | 162/343 |
| 4,543,162 | 9/1985 | Hildebrand | 162/344 |
| 4,687,548 | 8/1987 | Ilmoniemi et al. | 162/216 |
| 4,888,094 | 12/1989 | Weisshuhn et al. | 162/198 |
| 4,897,158 | 1/1990 | Weisshuhn et al. | 162/259 |
| 4,898,643 | 2/1990 | Weisshuhn et al. | 162/259 |

FOREIGN PATENT DOCUMENTS

| | | | |
|---|---|---|---|
| 768222 | 8/1934 | France | 162/344 |
| 3535849A1 | 4/1987 | Germany . | |

OTHER PUBLICATIONS

"Der Einfluss des Stoffauflaufes auf Asymmetriefehler im Papier" by D. Egelhof Heidenheim, Sonderdruck aus Das Papier Nr. Jul. 1986, Seite 313–318, pp. 2–7.

"Uber die Messung der Faserorientierung in einem Papierblatt Mittels Laserstrahlung," by W. Bauer, et al., *Wochenblatt Fur Papierfabrikation,* 1988, pp. 461–462, 464–466 and 468.

*Primary Examiner*—Karen M. Hastings
*Attorney, Agent, or Firm*—Marshall, O'Toole, Gerstein, Murray & Borun

[57] ABSTRACT

A headbox for a machine for the manufacture of paper from a web of paper pulp has an upper lip and a lower lip disposed below the upper lip and operatively associated with the upper lip to form an interior region between the lower lip and the upper lip and a discharge region. The shape of the lower lip, adjacent the discharge region, over which the web of paper pulp flows is adjustable. The shape may be adjusted by the rotation of a round, rotatable member disposed flush with the lower lip of the headbox or by the deformation of a deformable member provided at the discharge region.

14 Claims, 2 Drawing Sheets

Fig. 4
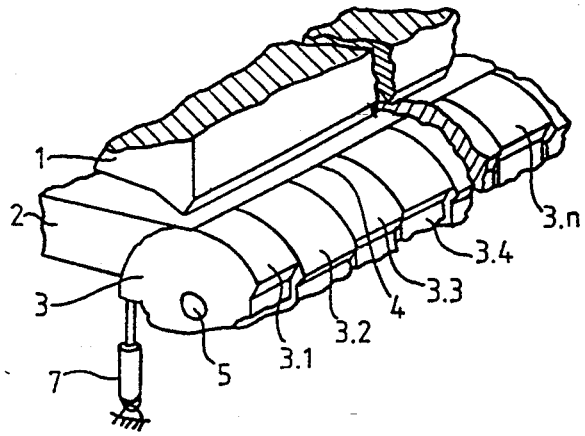
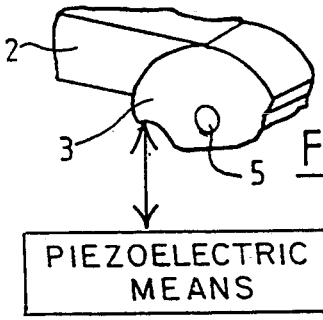
Fig. 5A
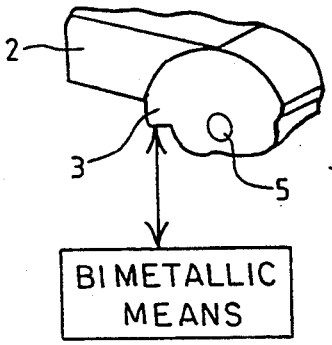
Fig. 5B
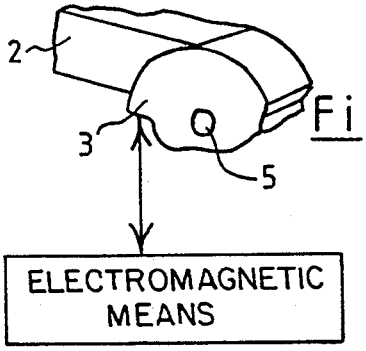
Fig. 5C
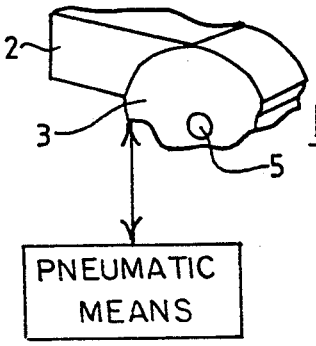
Fig. 5D
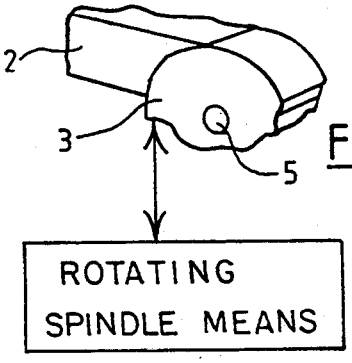
Fig. 5E

PAPER MACHINE HEADBOX WITH ADJUSTABLE LOWER LIP

BACKGROUND OF THE INVENTION

The invention is concerned with a headbox for a paper machine for making paper from a web of paper pulp, with the headbox having an adjustable lower lip.

A headbox for a paper machine should adjust the pulp density and fiber orientation profile of the paper pulp suspension, at the latest, before the suspension passes through the discharge slit of the headbox, so that the pulp density and fiber orientation profiles of the paper web correspond to the desired requirements over the entire width of the web, meaning, as a rule, that they are constant.

When operating a paper machine, there are many perturbing factors which hinder the achievement of the two above requirements. These perturbing factors include, for example, temperature and pressure fluctuations, manufacturing tolerances, and defects in the design or adjustment of the paper machine for the production process after the paper pulp is discharged from the headbox.

In order to influence these factors, the following state of the art has become known. German publication DE 35 14 554 proposes to change the pulp density locally; that is, to adjust the pulp density at certain points, depending on demand. However, it is not described how this should be accomplished.

German publication DE 40 19 593 A1 recommends that, upon deviation of the pulp density profile of the paper web at a certain point of the web width, the concentration $C_M$ of the respective section flow, and thus that of the flow leaving the respective mixer, should be changed correspondingly. In order to achieve this, the ratio of the amounts of control flows $Q_N/Q_L$, introduced to the mixture are changed. However, in the case of valves of the usual construction, it is difficult to avoid deviation of the section flow $Q_M$ leaving the mixer from the required value in an uncontrolled and unwanted manner.

In addition, it is known from German publication DE-OS 35 38 466 that a change of the volume flow of a section leads to influencing the fiber orientation angle in the discharge section of the headbox. If a section flow deviates from the required value in an uncontrolled manner, the fiber orientation will also change in an uncontrolled manner.

Furthermore, it is known from German publications DE 29 42 966 and DE-OS 35 35 849 that one can change the width of the discharge slit, for example, with threaded spindles for horizontally swinging or bending the upper lip. As a result, the throughput of the suspension can be altered locally. However, at the same time, the flow direction is also influenced locally, and thus the fiber orientation is affected. Namely, at the narrow parts of the discharge slit, the fibers will be disposed in a different flow direction than at the other parts of the discharge slit. This means that, although the consistency can be made uniform over the width of the headbox by this method of control, called displacement control, the originally good fiber orientation is destroyed.

SUMMARY OF THE INVENTION

The present invention is directed to a headbox for a machine for the manufacture of paper from a web of paper pulp. The headbox has an upper lip and a lower lip, disposed below the upper lip and operatively associated with the upper lip, so as to form an interior region between the lower lip and the upper lip and a discharge region. The discharge region has a curvature which is adjustable. The curvature of the lower lip adjacent the discharge region may be adjusted piezoelectrically, bimetallically, hydraulically, pneumatically, electromagnetically, or via rotating spindles.

In one aspect, the headbox has a rotatable member disposed adjacent the discharge region along the width of the headbox. The rotatable member has a surface which is flush with the surface of the lower lip of the headbox. The rotatable member is composed of steel and has a round shape, a portion having a planar surface, and a nose which points away from the interior region of the headbox. The rotatable member is rotatably supported so that paper pulp may flow from the interior region of the headbox and assume a downward curvature due to the round surface of the rotatable member. The rotatable member of the headbox may be provided with a plurality of sections, each of which is individually adjustable. In another aspect, the lower lip of the headbox may be provided with a deformable member disposed flush with the surface of the lower lip. The deformable member may be deformable by at least one supporting member, which may be rotatably supported.

These and other features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 4 is a perspective view of the embodiment of the headbox of FIG. 1; and FIGS. 5A–5E illustrate various actuation means for actuating the support elements of FIGS. 3 and 4.

DETAILED DESCRIPTION OF THE PREFERRED EMBODIMENTS

Figure 1:
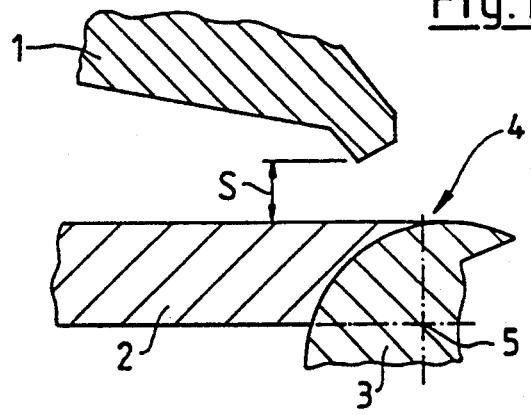
FIG. 1 is a cross-sectional view of one embodiment of a headbox in accordance with the invention.

FIG. 1 shows a cross-section of one embodiment of a headbox in accordance with the invention. The headbox has a sloping upper lip 1 and a horizontal lower lip 2 operatively associated with the upper lip 1 to form an interior region between the lips 1, 2. The upper lip 1 lies on top of the lower lip 2 and slopes downwardly towards the lower lip 2 in the direction of paper pulp flow through the headbox, from left to right in FIG. 1. The right end of the upper lip 1 and the lower lip 2 of the headbox form a discharge region or slit S between them.

The headbox includes a rotatable member or jet guide device 3 which consists of a round steel member, cut in approximately a half-moon shape when viewed in cross-section, the outside surface of which adjoins and is flush with the fixed part of the lower lip 2. The jet guide device 3 has a nose which points away from the interior region of the headbox. The jet guide device 3 is supported so that it can rotate about an axis 5, and its surface is flush with the surface of lower lip 2.

The transition point 4 from the lower lip 2 to the jet guide device 3, or the point at which those two members are adjacent, lies after discharge slit S, or to the right of the discharge slit S as shown in FIG. 1. Alternatively, in order to avoid or reduce disturbances in the flow of the paper pulp, the transition point 4 can be placed before the discharge slit S, that is, in the closed area of the headbox to the left of the discharge slit 4 as shown in FIG. 2.

By rotating the jet guide device 3, the outside curvature of the jet guide device 3 is guided into the paper pulp jet which lies on the surface of the jet guide device 3 as a result of the Coanda effect and is deflected corresponding to the curvature of the surface of the jet guide device 3.

Figure 2:
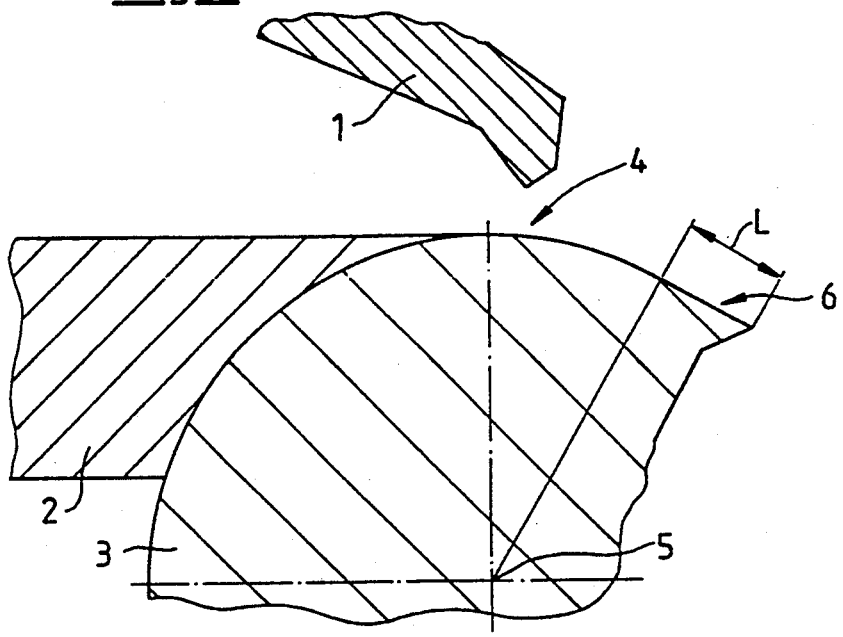
FIG. 2 is a cross-sectional view of a second embodiment of a headbox in accordance with the invention.

FIG. 2 illustrates a cross-section of an alternative embodiment of a headbox. In the headbox of FIG. 2, the transition point 4 from the headbox lower lip 2 to the jet guide device 3 is moved to the left as compared with the embodiment of FIG. 1. Also, the jet guide device 3 of FIG. 2 is designed in such a way that, in the nose region 6 of the jet guide device 3, a flat surface is formed over a length L of the jet guide device 3. As a result, a better laminar flow is achieved in this region.

Figure 3:
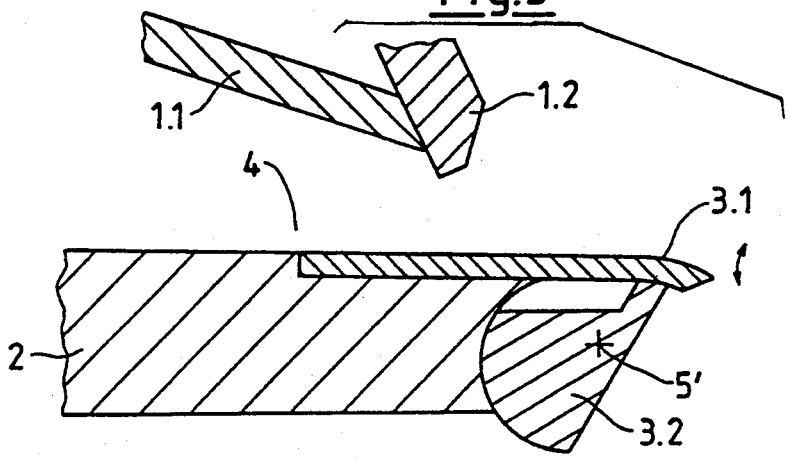
FIG. 3 is a cross-sectional view of a third embodiment of a headbox in accordance with the invention.

FIG. 3 is a cross-section of another embodiment of a headbox. In the headbox of FIG. 3, the upper lip 1.1, which lies on top of the lower lip 2, is shown with a slidable member 1.2 so that the width of the discharge slit S is variable. The lower lip 2 of the headbox has a horizontal recess machined therein, and an elastic, flat, deformable member 3.1 is disposed in the recess. The deformable member 3.1 protrudes beyond the end of lower lip 2. The transition point 4 between lower lip 2 and the deformable member 3.1 is situated far back in the interior of the headbox so that any turbulence that occurs will come to rest when the paper pulp jet leaves the nozzle and thus no flow perturbations will result.

The curvature of the end of the deformable member 3.1 is adjustable by a supporting element 3.2, which is secured at the end of the deformable member 3.1 and is supported around the axis 5.

The curved elements 3 shown in FIGS. 1–3 in the discharge region of the headbox lower lip 2 are divided into a plurality of sections, each of which is individually adjustable over the width of the machine so that each portion of the width of the paper pulp jet emitted by the headbox may be individually controlled.

In the operation of the headbox of FIG. 3, the curvature or shape of the deformable member 3.1 may be adjusted via the rotation of the supporting element 3.2. The rotation of the supporting element 3.2, and the elements 3 of FIGS. 1 and 2, may be controlled electromagnetically, pneumatically, hydraulically, piezoelectrically, bimetallically, by rotating spindles, or in any other manner by one or more of a number of corresponding actuating means. As a result, the fiber orientation transverse profile, the direction of the paper pulp jet, the transverse profile of the paper pulp jet, and the basis weight transverse profile of the jet may be controlled.

FIG. 4 is a perspective view of the embodiment of the headbox of FIG. 1. As shown in FIG. 4, the jet guide device 3 has a plurality of individually adjustable sections 3.1, 3.2, 3.3, 3.4 . . . , 3.n provided across the width of the headbox. The adjustment of each section is accomplished by rotating the section, such as by a hydraulic cylinder 7 shown coupled to the section 3.1. It should be understood that the embodiments of FIGS. 2 and 3 may also be provided with a plurality of individually adjustable sections similar to the sections illustrated in FIG. 4. As a result of the sections being individually adjustable, the angle of impact of the paper pulp jet onto a dewatering screen (not shown) can be influenced section-by-section.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A headbox for a machine for the manufacture of paper from a web of paper pulp, said headbox comprising:

an upper lip;

a lower lip disposed below said upper lip and operatively associated with said upper lip so as to form an interior region between said lower lip and said upper lip and a discharge region, said lower lip having a surface;

a rotatable member disposed adjacent said discharge region of the headbox along the width of the headbox, said rotatable member having a curved surface, said curved surface being flush with said surface of said lower lip; and support means for rotatably supporting said rotatable member so that paper pulp may flow from said interior region of the headbox and assume a downward curvature to to said curved surface of said rotatable member.

2. A headbox as defined in claim 1 wherein said rotatable member comprises a plurality of rotatable sections disposed along the width of the headbox, each of said rotatable sections being supported by said support means, and each of said rotatable sections being individually rotatable.

3. A headbox as defined in claim 1 or 2 additionally comprising piezoelectric means for adjusting the rotatable position of said rotatable member.

4. A headbox as defined in claim 1 or 2 additionally comprising bimetallic means for adjusting the rotatable position of said rotatable member.

5. A headbox as defined in claim 1 or 2 additionally comprising hydraulic means for adjusting the rotatable position of said rotatable member.

6. A headbox as defined in claim 1 or 2 additionally comprising electromagnetic means for adjusting the rotatable position of said rotatable member.

7. A headbox as defined in claim 1 or 2 additionally comprising pneumatic means for adjusting the rotatable position of said rotatable member.

8. A headbox as defined in claim 1 wherein said rotatable support member has a flat surface adjacent said curved surface.

9. A headbox for a machine for the manufacture of paper frown a web of paper pulp, said headbox comprising:

an upper lip;

a lower lip disposed below said upper lip and operatively associated with said tipper lip so as to form an interior region between said lower lip and said upper lip and a discharge region, said lower lip having a surface;

a deformable member disposed flush with said surface of said lower lip, said deformable member having an end with a curvature;

a rotatable supporting element disposed beneath said deformable member at a position outside said interior region of the headbox, said supporting element being movable so as to deform the curvature of the end of said deformable member at a point outside said interior region of the headbox; and means for rotatably supporting said supposing element.

10. A headbox as defined in claim 9 additionally comprising pneumatic means for moving said supporting element to deform said deformable member.

11. A headbox as defined in claim 9 additionally comprising hydraulic means for moving said supporting element to deform said deformable member.

12. A headbox as defined in claim 9 additionally comprising rotating spindle means for moving said supporting element to deform said deformable member.

13. A headbox as defined in claim 9 additionally comprising piezoelectric means for moving said supporting element to deform said deformable member.

14. A headbox as defined in claim 9 additionally comprising bimetallic means for moving said supporting element to deform said deformable member.

* * * * *